US009273677B2

(12) United States Patent
Youell

(10) Patent No.: US 9,273,677 B2
(45) Date of Patent: Mar. 1, 2016

(54) UNIVERSAL WET/DRY TRANSFER PUMP

(71) Applicant: Bradley S. Youell, Anaheim, CA (US)

(72) Inventor: Bradley S. Youell, Anaheim, CA (US)

( * ) Notice: Subject to any disclaimer, the term of this patent is extended or adjusted under 35 U.S.C. 154(b) by 76 days.

(21) Appl. No.: 14/177,607

(22) Filed: Feb. 11, 2014

(65) Prior Publication Data

US 2014/0224359 A1 Aug. 14, 2014

Related U.S. Application Data

(63) Continuation-in-part of application No. 12/931,754, filed on Feb. 9, 2011, now abandoned.

(51) Int. Cl.

| | |
|---|---|
| ***E02F 3/02*** | (2006.01) |
| ***F04B 23/02*** | (2006.01) |
| ***E02F 3/88*** | (2006.01) |
| ***F04B 43/00*** | (2006.01) |
| ***F04B 53/16*** | (2006.01) |

(52) U.S. Cl.

CPC ..... *F04B 23/021* (2013.01); *E02F 3/02* (2013.01); *E02F 3/8891* (2013.01); *F04B 43/0054* (2013.01); *F04B 53/16* (2013.01); *Y10T 137/85986* (2015.04)

(58) Field of Classification Search

CPC ..... E02F 3/02; E02F 3/88; E02F 3/8891; E02F 3/90; F04B 45/02; F04B 23/021; F04B 23/0054; F04B 53/16; Y10T 29/49877; Y10T 137/85986

USPC ..... 37/307; 417/472; 222/387

See application file for complete search history.

(56) References Cited

U.S. PATENT DOCUMENTS

| | | | | | |
|---|---|---|---|---|---|
| 1,382,081 | A | * | 6/1921 | Heiliger | 29/454 |
| 1,516,359 | A | * | 11/1924 | Tideman | 137/577.5 |
| 1,561,065 | A | * | 11/1925 | Eggleston | 92/42 |
| 1,582,399 | A | * | 4/1926 | Helander | 137/140 |
| 2,021,156 | A | * | 11/1935 | Smith | 417/472 |
| 2,678,006 | A | * | 5/1954 | Gray | 417/547 |
| 2,886,066 | A | * | 5/1959 | Hansen | 285/114 |
| 3,549,015 | A | * | 12/1970 | Willinger | 210/416.2 |
| D280,992 | S | * | 10/1985 | Maruyama | D15/7 |
| 4,552,515 | A | * | 11/1985 | Endo | 417/472 |
| 4,739,904 | A | * | 4/1988 | Spencer et al. | 222/109 |
| 4,807,373 | A | * | 2/1989 | Sloan et al. | 37/322 |
| 4,869,404 | A | * | 9/1989 | Elliott | 222/385 |
| 4,944,101 | A | * | 7/1990 | Goble | 15/1.7 |
| 5,135,647 | A | * | 8/1992 | Childers | 210/136 |
| 5,244,365 | A | * | 9/1993 | Catcher | 417/569 |
| 5,601,316 | A | * | 2/1997 | Totino et al. | 285/226 |
| 6,334,760 | B1 | * | 1/2002 | Walker | 417/313 |

* cited by examiner

*Primary Examiner* — Jamie L McGowan

(74) *Attorney, Agent, or Firm* — Ruth Eure; Emery Tracy

(57) ABSTRACT

The present invention is a universal wet/dry transfer pump having an intake hose and a t-joint. The intake hose is fluidly connected to the t-joint. A first check valve is positioned within the intake hose. A bellowed pump handle is fluidly connected to the t-joint. A separator hose is provided and fluidly connected to the t-joint. A second check valve is positioned within the t-joint. A terminal catchment vessel is fluidly connected to the separator hose. Upon pulling of the pump handle in a generally upward direction, intake pumping action is initiated drawing water and solid materials into the intake hose, opening the first check valve and closing the second check valve. Upon pushing of the pump handle in a generally downward direction, discharge pumping action is initiated, closing the first check valve and opening the second check valve transferring any water and chambered solids into the catchment vessel.

11 Claims, 11 Drawing Sheets

UNIVERSAL WET/DRY TRANSFER PUMP

CLAIM OF PRIORITY

The present application is a continuation-in-part of pending patent application Ser. No. 12/931,754, filed on Feb. 9, 2011, entitled "Portable Suction Separator Dredge", which claims benefit of priority of provisional patent application Ser. No. 61/339,426, filed on Mar. 4, 2010, entitled "Portable Suction Separator Dredge".

BACKGROUND OF THE INVENTION

1. Field of the Invention

This invention relates generally to a universal wet/dry transfer pump and, more particularly, the invention relates to a universal wet/dry transfer pump which is a manually operated, portable suction device for many applications including, but not limited to, small-scale dredging and sampling operations.

2. Description of the Prior Art

Thousands of people enjoy prospecting for gold and millions of people own recreational boats. At first, these groups might appear to have little in common; but one thing they do share is the need for a portable, effective dredging device. The prospector wants to suction sand, gold-bearing gravels, and water from stream and river bars and channels, and separate the heavier gold and gravels from the liquid; and the boater may wish to perform either regular bilge maintenance pumping or small-scale dredging of his boat-slip or docking area. In larger and commercial aquarium operations such a separating dredge can be used in cleaning tanks and gravels.

SUMMARY

The present invention is a universal wet/dry transfer pump for moving water and material in dredging and sampling operations. The universal wet/dry transfer pump comprises an intake hose having an intake end and an outtake end and a t-joint having an intake port, a handle port, and a separator hose port. The outtake end of the intake hose is fluidly connected to the intake port of the t-joint. A first check valve is positioned between the separator hose port and the intake end of the intake hose with a first groove hinge formed in the first check valve defining a first stationary portion and a first movable portion and the first movable portion movable relative to the first stationary portion along the first groove hinge. A bellowed pump handle is fluidly connected to the handle port of the t-joint. A separator hose having a first end and a second end is provided with the first end of the separator hose fluidly connected to the separator hose port of the t-joint. A second check valve is positioned between the second end of the separator hose and the t-joint with a second groove hinge formed in the second check valve defining a second stationary portion and a second movable portion and the second movable portion movable relative to the second stationary portion along the second groove hinge. A terminal catchment vessel is fluidly connected to the second end of the separator hose. Upon pulling of the pump handle in a generally upward direction, intake pumping action is initiated drawing water and solid materials into the intake hose, opening the first check valve and closing the second check valve. Upon pushing of the pump handle in a generally downward direction, discharge pumping action is initiated, closing the first check valve and opening the second check valve transferring any water and chambered solids into the catchment vessel.

In addition, the present invention includes a universal wet/dry transfer pump for moving water and material in dredging and sampling operations. The universal wet/dry transfer pump comprises an intake hose having an intake end and an outtake end and a t-joint having an intake port, a handle port, and a separator hose port. The outtake end of the intake hose is fluidly connected to the intake port of the t-joint. A first check valve is positioned between the separator hose port and the intake end of the intake hose. A bellowed pump handle is fluidly connected to the handle port of the t-joint with the bellowed pump handle having a plurality of crests and a plurality of valleys. A plurality of tubular supports is provided with a single tubular support positioned in each crest and a plurality of bands are provided with a single band positioned within each valley. A separator hose having a first end and a second end is provided with the first end of the separator hose fluidly connected to the separator hose port of the t-joint. A second check valve is positioned between the second end of the separator hose and the t-joint. A terminal catchment vessel is fluidly connected to the second end of the separator hose. Upon pulling of the pump handle in a generally upward direction, intake pumping action is initiated drawing water and solid materials into the intake hose, opening the first check valve and closing the second check valve. Upon pushing of the pump handle in a generally downward direction, discharge pumping action is initiated, closing the first check valve and opening the second check valve transferring any water and chambered solids into the catchment vessel.

DETAILED DESCRIPTION OF THE PREFERRED EMBODIMENTS

Figure 1:
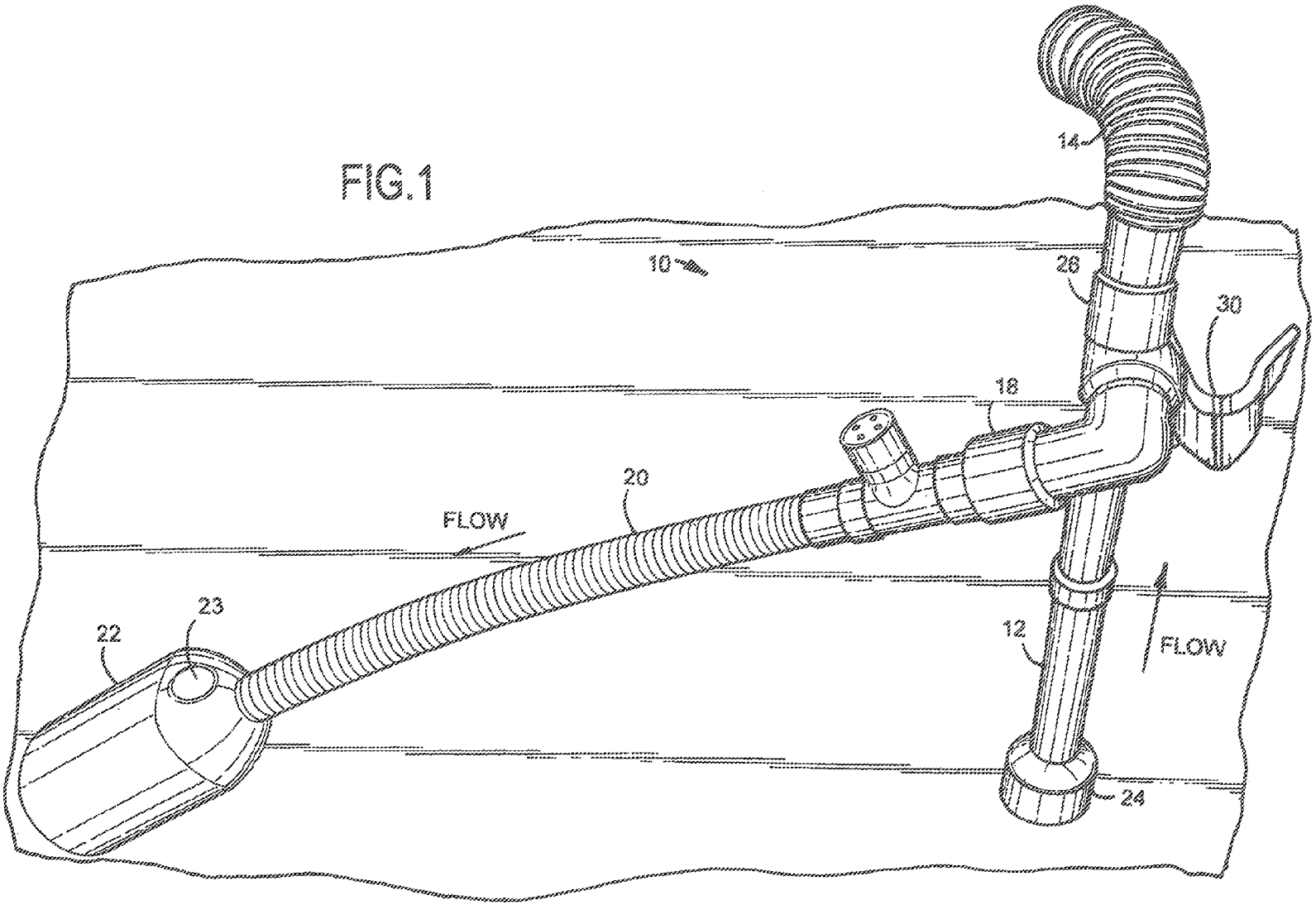
FIG. 1 is a perspective view illustrating a universal wet/dry transfer pump, constructed in accordance with the present invention.
Figure 2:
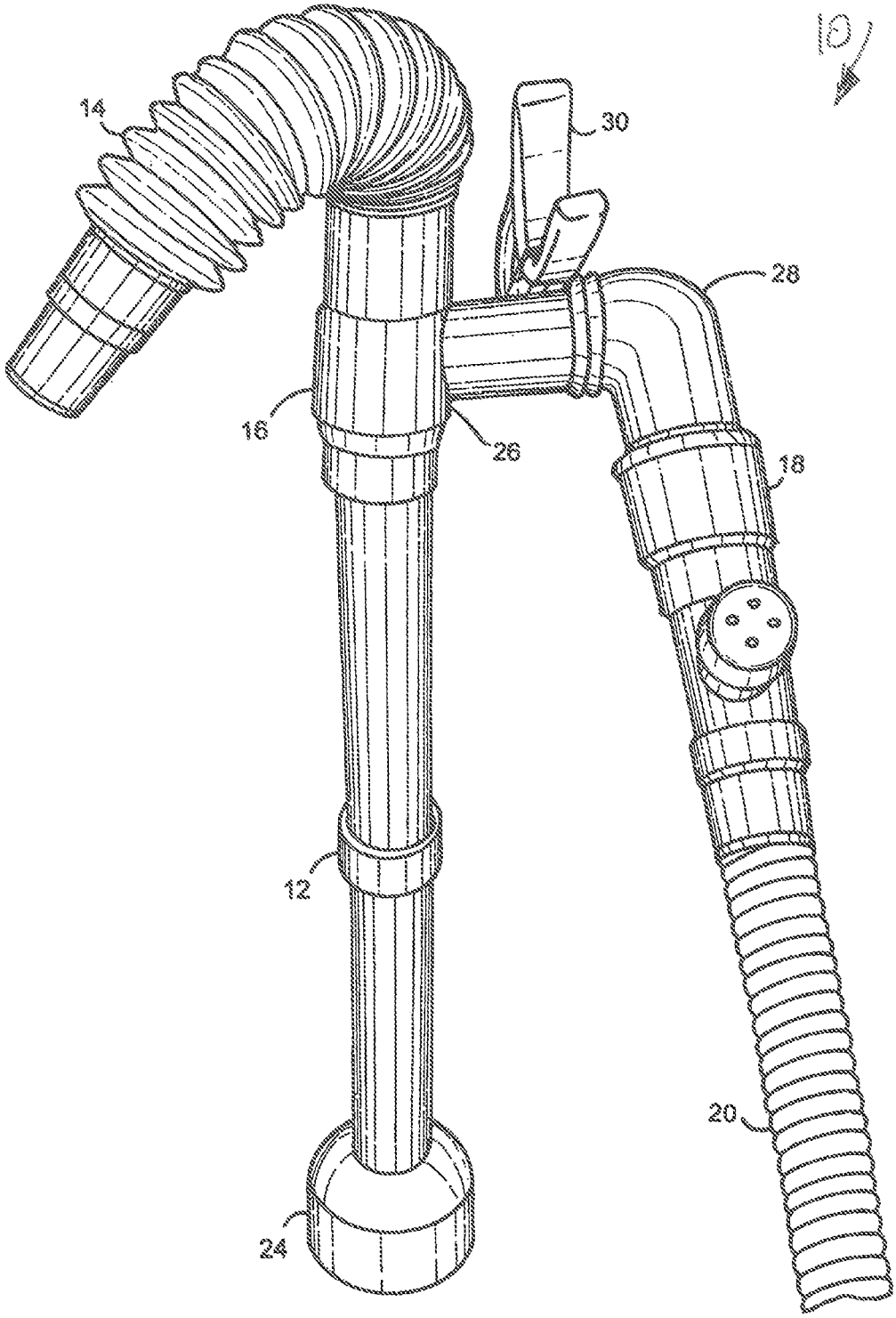
FIG. 2 is another perspective view illustrating the universal wet/dry transfer pump, constructed in accordance with the present invention.
Figure 3:
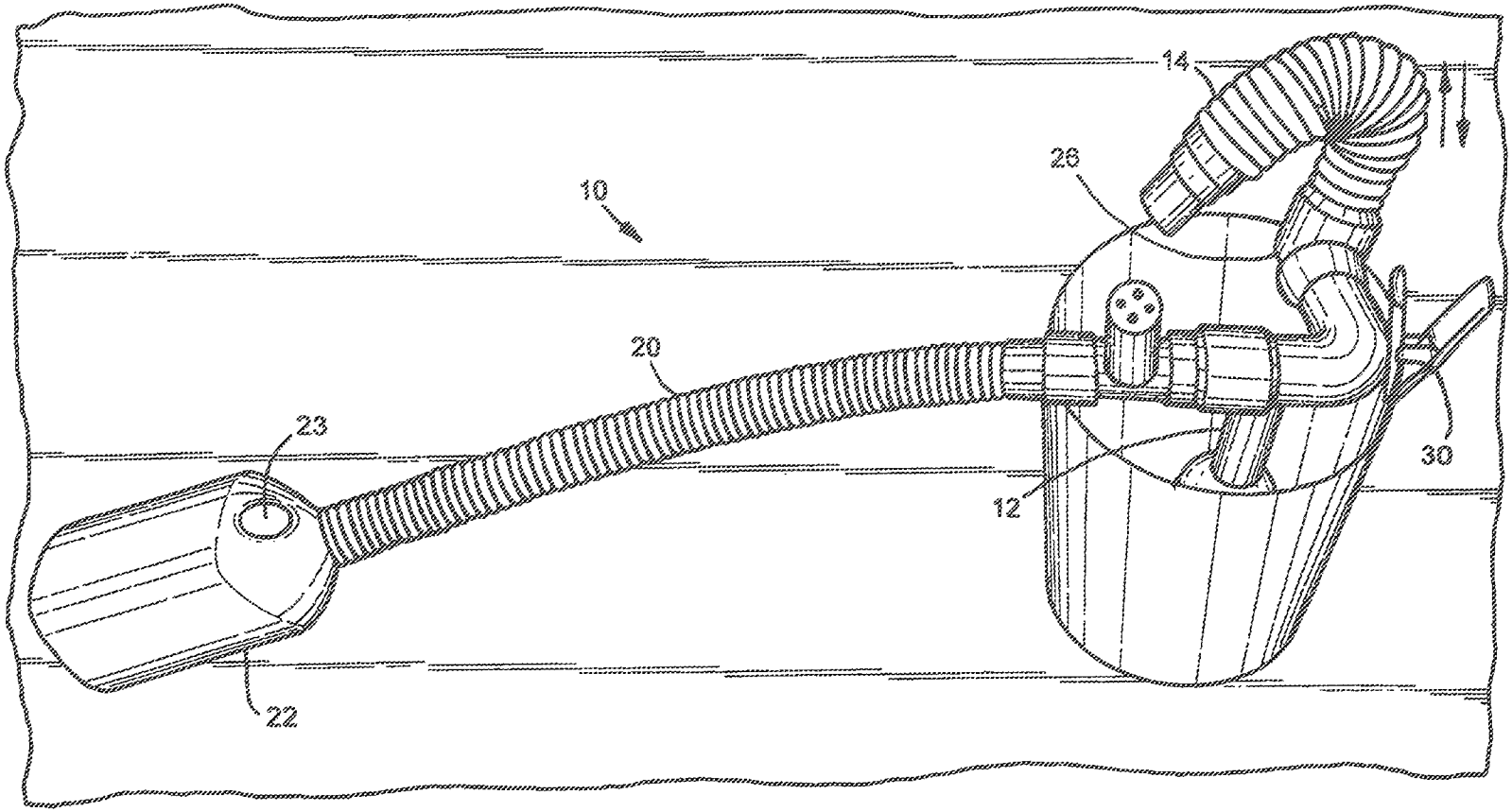
FIG. 3 is still another perspective view illustrating the universal wet/dry transfer pump, constructed in accordance with the present invention.
Figure 4:
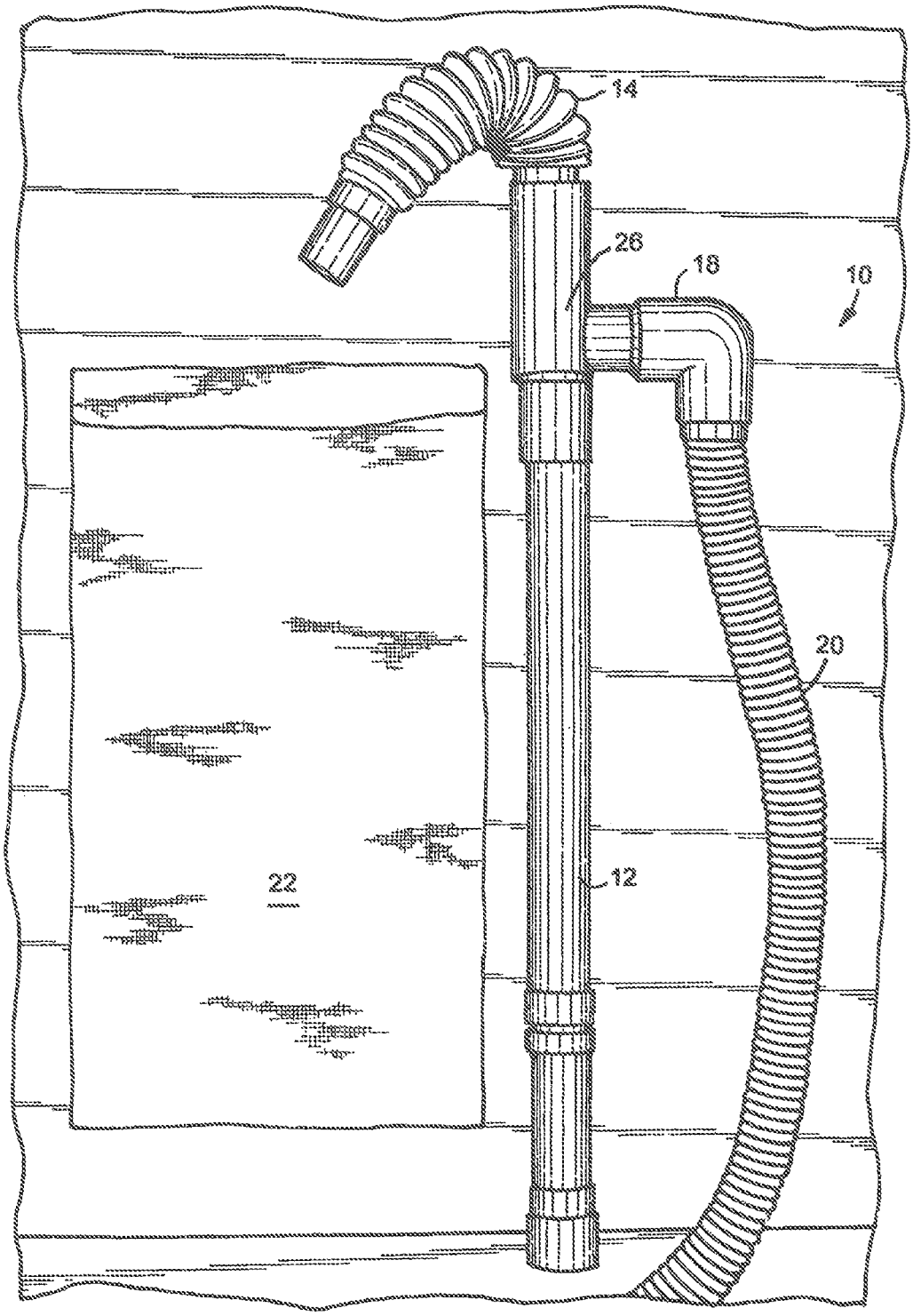
FIG. 4 is yet another perspective view illustrating the universal wet/dry transfer pump, constructed in accordance with the present invention.
Figure 5:
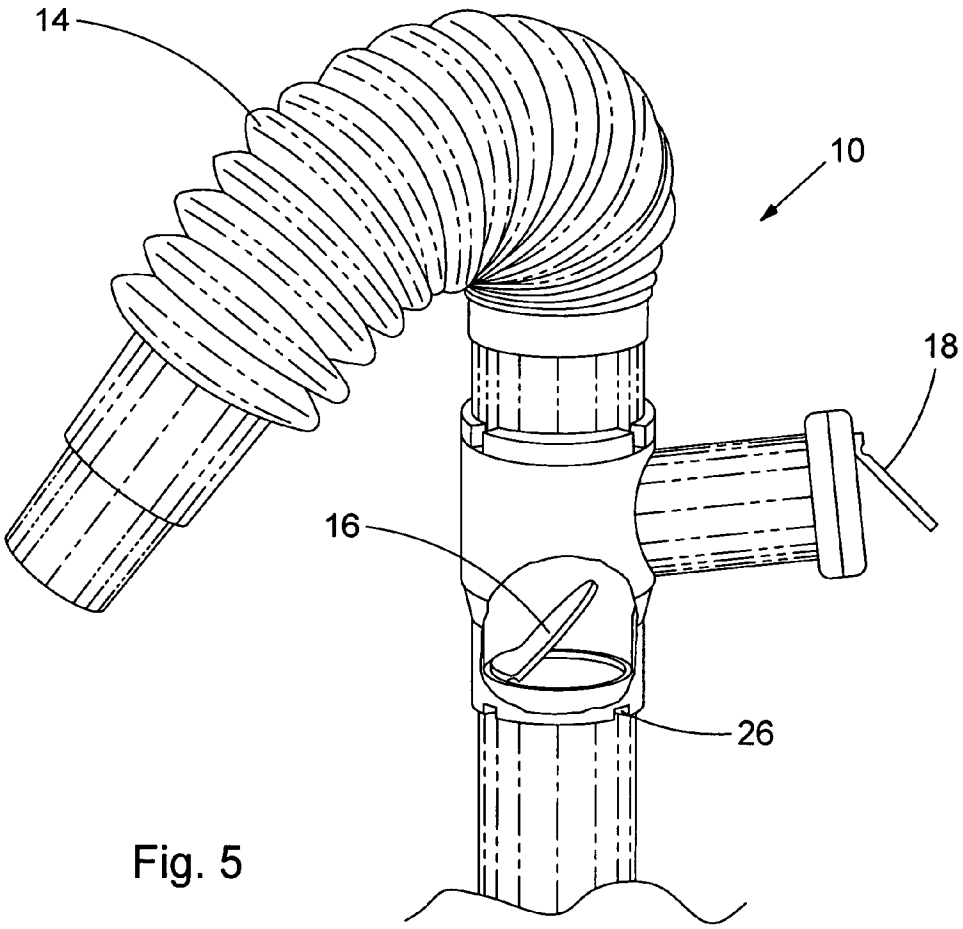
FIG. 5 is a perspective view illustrating the universal wet/dry transfer pump, constructed in accordance with the present invention, with an anti-siphon valve.
Figure 7:
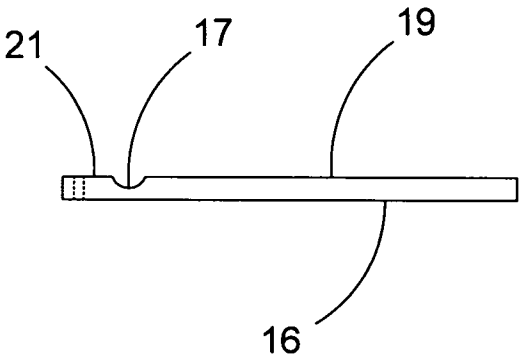
FIG. 7 is an elevational side view illustrating the flap valve of the universal wet/dry transfer pump of FIG. 6, constructed in accordance with the present invention.
Figure 6:
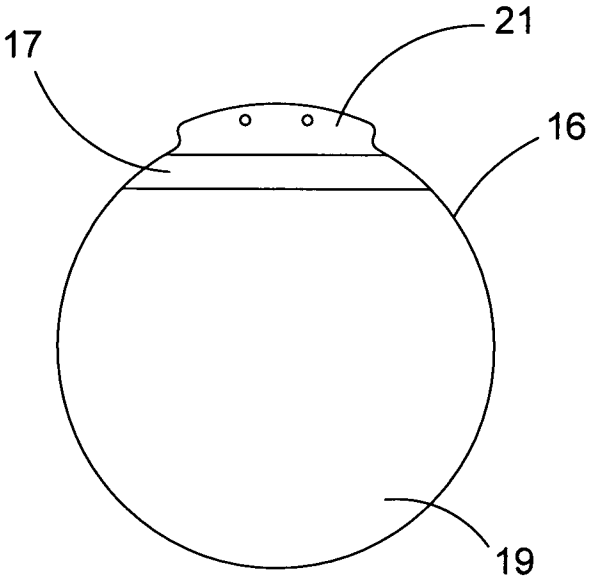
FIG. 6 is a top plan view illustrating a flap valve of the universal wet/dry transfer pump, constructed in accordance with the present invention, with a groove formed in the flap valve.
Figure 9:
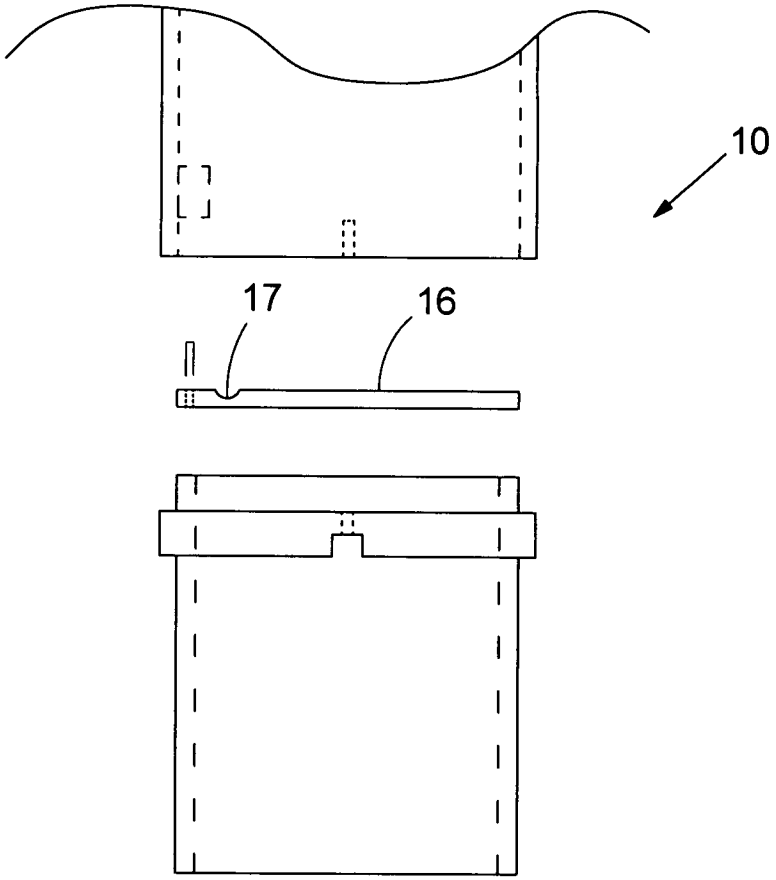
FIG. 9 is a sectional elevational side view illustrating the flap valve of the universal wet/dry transfer pump.
Figure 8:
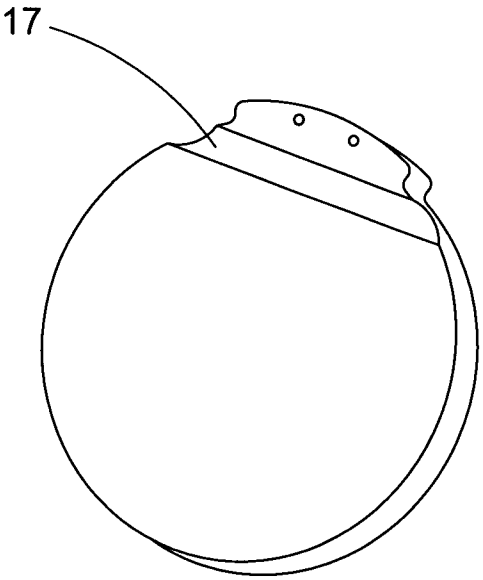
FIG. 8 is a top plan view illustrating the flap valve for the intake of the universal wet/dry transfer pump, constructed in accordance with the present invention.
Figure 11:
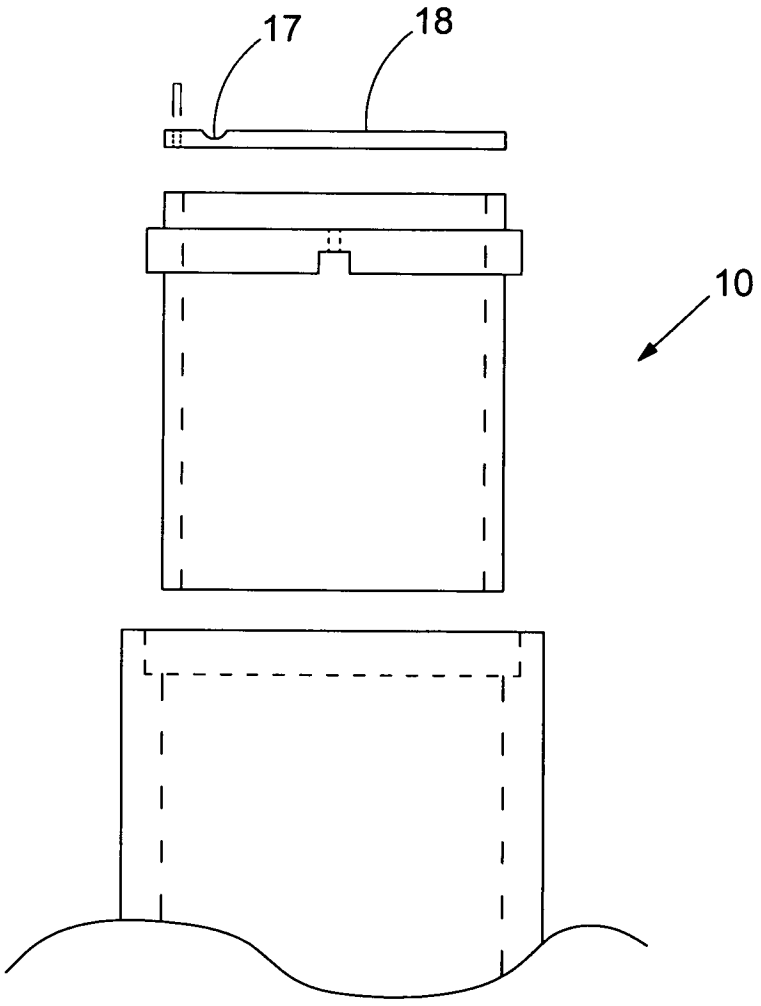
FIG. 11 is a sectional elevational side view illustrating the second valve of the universal wet/dry transfer pump.
Figure 10:
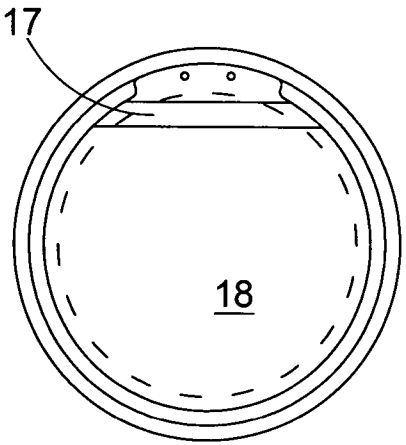
FIG. 10 is a top plan view illustrating the flap valve for the discharge pipe of the universal wet/dry transfer pump, constructed in accordance with the present invention.
Figure 13:
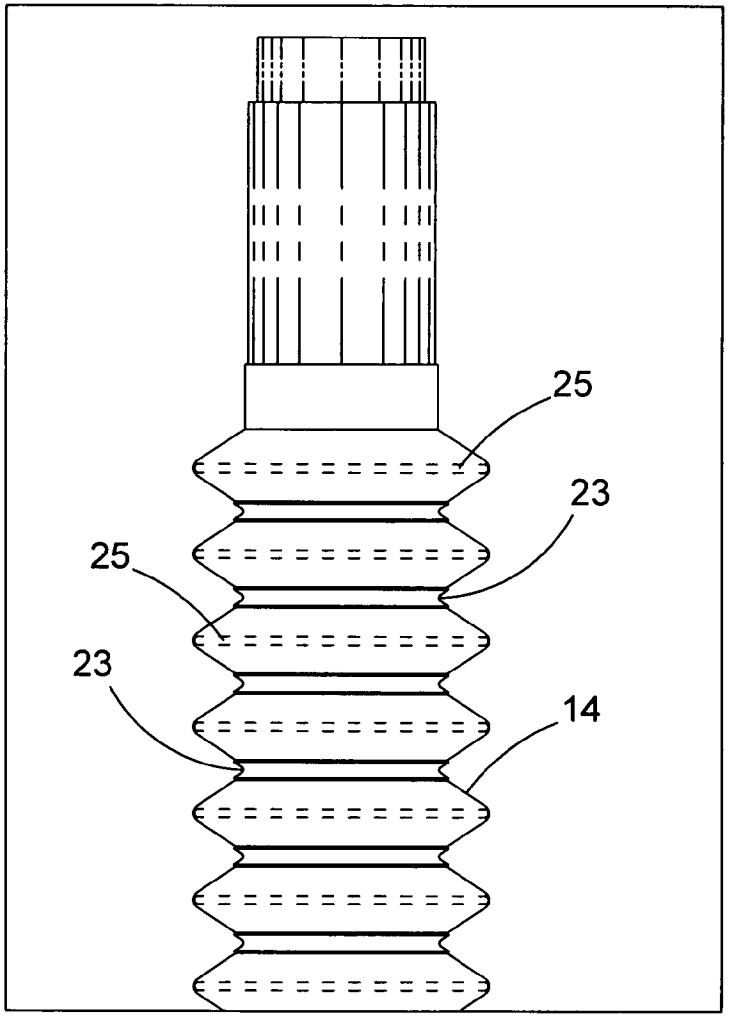
FIG. 13 is an elevational side view illustrating the tubular support and the outside band mounted to the pump handle bellow of the universal wet/dry transfer pump, constructed in accordance with the present invention, with the O-ring inserted in the narrow sections of the accordion hose.
Figure 12A:
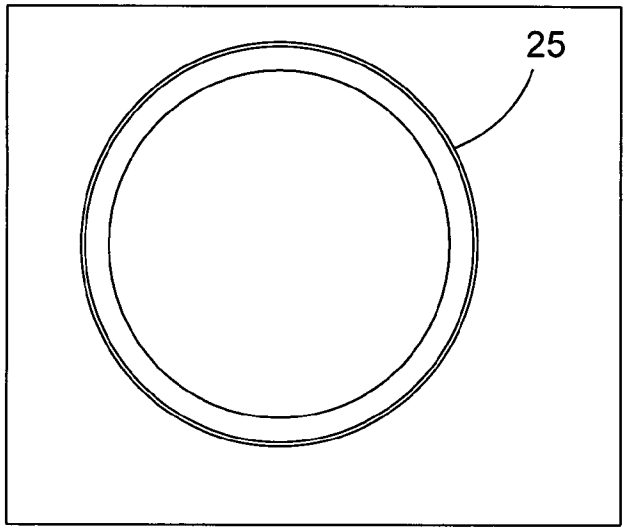
FIG. 12*a* is a perspective view illustrating a tubular support for the pump handle bellow of the universal wet/dry transfer pump, constructed in accordance with the present invention.
Figure 12B:
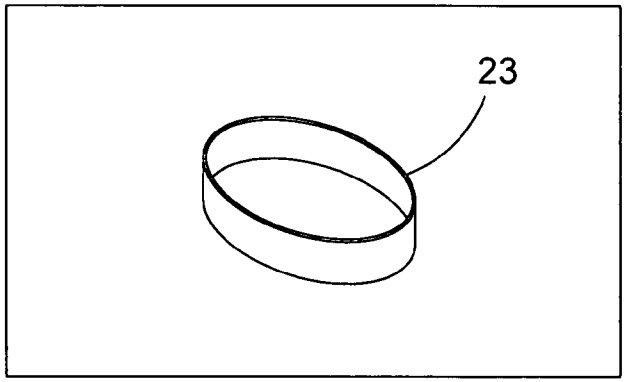
FIG. 12*b* is a perspective view illustrating an outside band for the pump handle bellow of the universal wet/dry transfer pump, constructed in accordance with the present invention.
Figure 14:
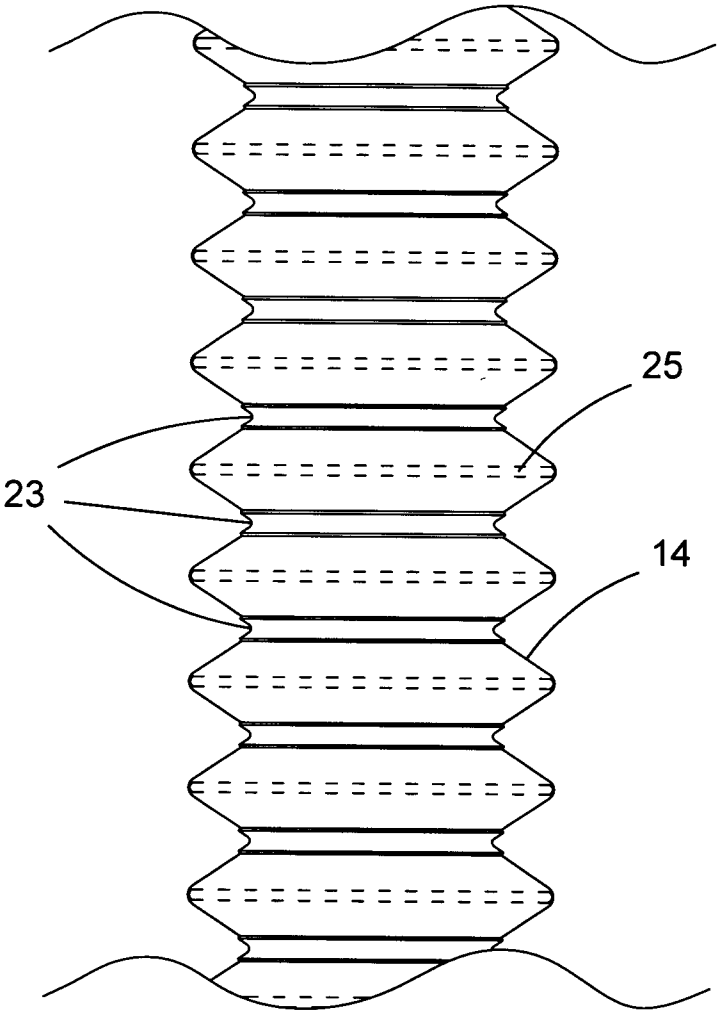
FIG. 14 is an elevational plan view illustrating the pump handle bellow of the universal wet/dry transfer pump, constructed in accordance with the present invention.
Figure 15:
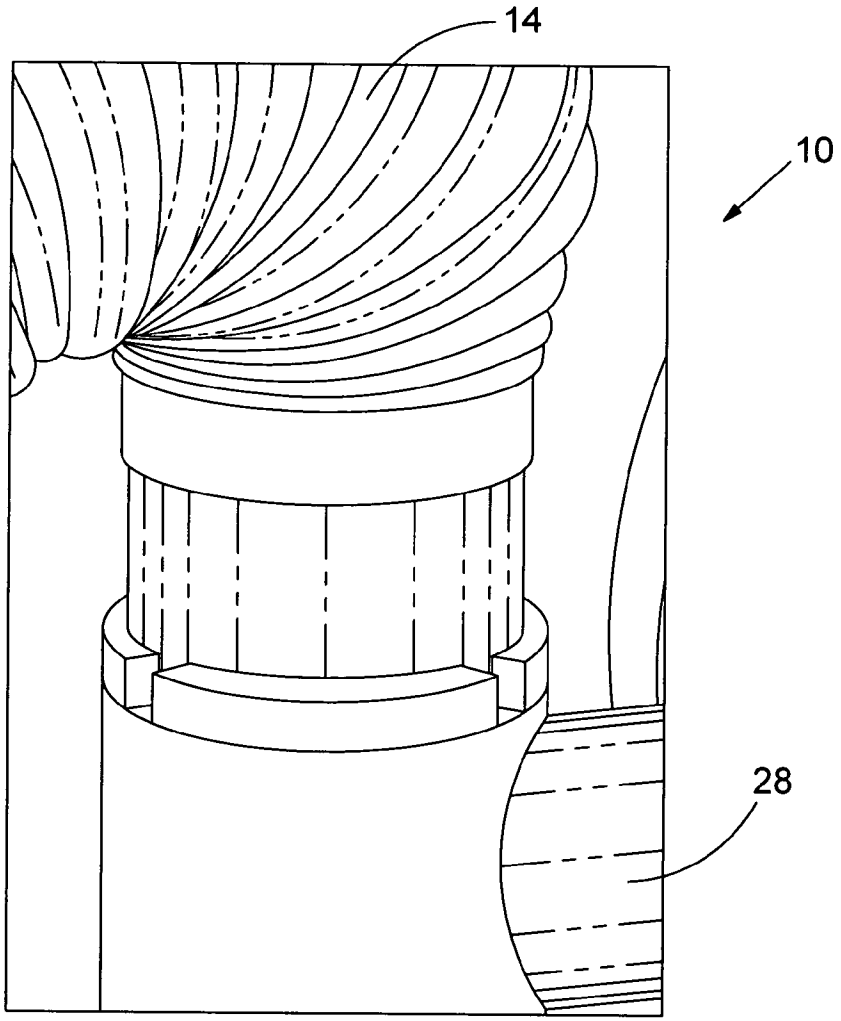
FIG. 15 is a perspective view illustrating notches for receiving screw heads of the universal wet/dry transfer pump, constructed in accordance with the present invention, for securing a valve cartridge to the pump body.

As illustrated in FIGS. 1-15, the present invention is a universal wet/dry transfer pump, indicated generally at 10, for moving water and material in small-scale dredging and sampling operations. The universal wet/dry transfer pump 10 of the present invention is basically a hand-operated vacuum-pump equipped with a long, flexible or rigid intake hose 12, a pump handle 14, a pair of check-valves 16, 18, a separator hose 20, and terminal catchment vessel 22 for collecting the solids, i.e., gravels, placer gold, and other heavier particulate matter, from the liquid matrix of the river, stream, aquarium, or other water source.

The intake hose 12 of the universal wet/dry transfer pump 10 of the present invention can be a rigid or flexible hose comprising a single piece or multiple pieces allowing the intake hose 12 to be extended and retracted, as desired. The intake hose 12 has an intake end and an outtake end. Preferably, a funnel device 24 is attached to the intake end of the intake hose 12 thereby expanding the scope of the opening of the intake hose 12. Mounted to the outtake end of the intake hose 12 is a t-joint 26 having an intake port, a handle port, and a separator hose port. The outtake end of the intake hose 12 is inserted into and fluidly connected to the intake port of the t-joint 26. The first check valve 16 is located in or adjacent the outtake end of the intake hose 12 allowing fluid and material to travel out the outtake end, but not allowing fluid and material to flow toward the intake end.

The pump handle 14 of the universal wet/transfer pump 10 of the present invention is fluidly connected to the handle port of the t-joint 26. The pump handle 14 is preferably accordion-style tubing or bellows creating a suction through the intake hose 12 when being pulled in a generally upward direction, opening the first check valve 16, and moving water and material into and out of the intake hose 12 through the outtake end during pumping operations. The bellows 14 are preferably constructed of a soft urethane rubber material so that the cylinder bellows are soft and pliable for minimizing operator fatigue while hand pumping and maximizing the transfer of fluid in a shorter time allowing rapid enough operation that the hand pump 14 can transfer dry material hand vacuuming. Operation of the pump handle 14 to create the vacuum will be described in further detail below.

As mentioned above, the bellowed pump handle 14 of the universal wet/dry transfer pump 10 of the present invention is preferably constructed from a soft, deformable elastomer material that produces a vacuum when stretched vertically and produces pressure when compressed. The number of bellows in the bellowed pump handle 14 can vary, but the intent of the design of the present invention is to move fluids at over thirty-two (32 oz.) ounces per stroke. The actual softness of the bellowed pump handle 14 allows rapid operation of the universal wet/dry transfer pump 10 so that dry material can be vacuumed.

As best illustrated in FIGS. 12*a*, 12*b*, 13, and 14, the deformable elastomer pump handle 14 is reinforced from within by filling the crests inside the bellowed pump handle 14 with a tubular support 25 to inhibit the bellowed pump handle 14 from collapsing under vacuum pressure. In addition, the bellowed pump handle 25 is reinforced within the valleys by adding a single band 23 on the outer surface of the bellowed pump handle 14 within each valley thereby reducing valley rise (i.e., bloating) during operation of the bellowed pump handle 14. Each band 23 is sufficiently thin for minimizing any interference in the operation of the bellowed pump handle 14 and to fill each valley of the bellowed pump handle 14 without stretching the bellowed pump handle 14. Furthermore, maintaining each band 23 as thin as possible inhibits each band 23 from reducing the pump stroke travel distance of the bellowed pump handle 14.

The separator hose 20 of the universal wet/dry transfer pump 10 of the present invention has a first end and a second end with the first end fluidly connected to the separator hose port of the t-joint 26. An elbow joint 28 can be connected between the separator hose 20 and the separator hose port, but is not necessarily required. The second check valve 18 is located adjacent the first end of the separator hose 20 allowing fluid and material to travel out the second end, but not allowing fluid and material to flow toward the first end. In alternate embodiment, the second check valve 18 can be positioned prior to the elbow joint 28.

As best illustrated in FIGS. 5-11, the first check valve 16 and the second check valve 18 of the universal wet/dry transfer pump 10 are each preferably constructed from a rubber or other elastomer material having a cracking pressure control groove 17 formed therein. The control groove 17 defines a movable flap portion 19 and a stationary flap portion 21. The stationary flap portion 19 is fixedly mounted while the movable flap portion 19 is free to move, with the control groove 17 functioning as a hinge line, as the fluid and material to move through the universal wet/dry transfer pump 10. The actual depth, width, and thickness of the control groove 17 regulates the cracking pressure of the check valves 16, 18. Preferably, the first check valve 16 and the second check valve 18 are each constructed from a single piece of material although constructing the first check valve 16 and the second check valve 18 from a multiple piece of material is within the scope of the present invention.

The catchment vessel 22 of the universal wet/dry transfer pump 10 of the present invention is fluidly secured to the second end of the separator hose 20. Preferably the catchment vessel 22 has a vent opening 23 offering pressure relief within the catchment vessel 22. The catchment vessel 22 can be a bottle or a bag.

Basically, the universal wet/dry transfer pump 10 of the present invention is a hand-powered, manually operated suction pump designed to separate and sequester the heavier, solid materials from the water. In essence, the user inserts or places the intake end of the intake hose 12 onto the material such as a submerged gravel bar in a riverbed, for example, that he or she wishes to remove and examine. The pump handle 14 of the universal wet/dry transfer pump 10 is then pumped by hand motion, and water and solid materials are drawn into the intake hose 12. The universal wet/dry transfer pump 10 uses a pair of check valves, i.e., the first check valve 16 and the second check valve 18. The first check valve 16 opens when intake pumping action is initiated, as described above, and closes when discharge is initiated (such as pushing in a generally downward direction on the pump handle 14), which opens the second check valve 18. Now reverse pumping is initiated, transferring any water and chambered solids at outfall. When the second check valve 18 is opened, water and solids are sent down the separator pipe 20 that ends, at the outfall, the catchment bottle or vessel 22 is affixed to the distal end of the separator hose 20, where the materials are retained for closer examination. An optional attachment device 30 connected to the t-joint can releasably attach the universal wet/dry transfer pump 10 to an object. The attachment device 30 has a circular hose clamp allowing the attachment device 30 to be positioned on any cylindrical portion of the universal wet/dry transfer pump.

The universal wet/dry transfer pump 10 of the present invention presents not only prospectors, but other users as well, with a tool of uncommon utility. Lightweight and easily portable, the universal wet/dry transfer pump 10 has been designed to vacuum streambed gravels and collect them into the catchment vessel 22 for closer examination easily and with only a pumping motion of the hands. As such, the universal wet/dry transfer pump 10 spares the prospector much of the back bending, kneeling work associated with traditional gold panning, and enables him or her to cover greater expanses of streambed bars and gravels more efficiently and faster. The lightweight portability and ease of operation achieved with the universal wet/dry transfer pump 10, however, benefits not only the solitary placer-gold prospector, but also presents benefits to recreational boaters, even to large-scale and commercial aquarium operators. Boaters and even marina operators will appreciate the efficiency with which the universal wet/dry transfer pump 10 can be used either as a small-scale, personal dredging device, or as a highly effective, solid-trapping bilge pump; and aquarium enthusiasts and operators who must frequently separate and clean tank-gravels for proper tank hygiene will undoubtedly appreciate a tough, sturdy, durable, and higher-volume device than the standard hobbyist hand-pumps that are generally available.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A universal wet/dry transfer pump for moving water and material in dredging and sampling operations, the universal wet/dry transfer pump comprising:

an intake hose having an intake end and an outtake end;

a t-joint having an intake port, a handle port, and a separator hose port, the outtake end of the intake hose fluidly connected to the intake port of the t-joint;

a first check valve positioned between the separator hose port and the intake end of the intake hose;

a first groove hinge formed in the first check valve defining a first stationary portion and a first movable portion, the first movable portion movable relative to the first stationary portion along the first groove hinge;

a bellowed pump handle fluidly connected to the handle port of the t-joint;

a separator hose having a first end and a second end, the first end of the separator hose fluidly connected to the separator hose port of the t-joint;

a second check valve positioned between the second end of the separator hose and the t-joint;

a second groove hinge formed in the second check valve defining a second stationary portion and a second movable portion, the second movable portion movable relative to the second stationary portion along the second groove hinge; and a terminal catchment vessel fluidly connected to the second end of the separator hose;

wherein upon pulling of the pump handle in a generally upward direction, intake pumping action is initiated drawing water and solid materials into the intake hose, opening the first check valve and closing the second check valve; and wherein upon pushing of the pump handle in a generally downward direction, discharge pumping action is initiated, closing the first check valve and opening the second check valve transferring any water and chambered solids into the catchment vessel.

2. The universal wet/dry transfer pump of claim 1 wherein the intake hose is rigid and constructed from multiple pieces allowing the intake hose to be extended and retracted.

3. The universal wet/dry transfer pump of claim 1 and further comprising:

a funnel device attached to the intake end of the intake hose thereby expanding the scope of the opening of the intake hose.

4. The universal wet/dry transfer pump of claim 1 wherein the pump handle is accordion-style tubing.

5. The universal wet/dry transfer pump of claim 1 and further comprising:

an elbow joint fluidly connected between the separator hose and the separator hose port.

6. The universal wet/dry transfer pump of claim 1 wherein the catchment vessel is a pressure relief vented closed solid container removable from the second end of the separator hose.

7. The universal wet/dry transfer pump of claim 1 and further comprising:

an attachment device connected to the t-joint for releasably attaching the dredge to a separate bucket, the attachment device being a hand clamp connected to a circular hose clamp.

8. The universal wet/dry transfer pump of claim 1 wherein the intake hose is rigid.

9. The universal wet/dry transfer pump of claim 1 wherein the separator hose are flexible.

10. The universal wet/dry transfer pump of claim 1 wherein the bellowed pump handle has a plurality of crests and a plurality of valleys, and further comprising:

a plurality of tubular supports, a single tubular support positioned in each crest inside the bellowed pump handle; and a plurality of bands, a single band positioned within each valley on an outer surface of the bellowed pump handle.

11. A universal wet/dry transfer pump for moving water and material in dredging and sampling operations, the universal wet/dry transfer pump comprising:

an intake hose having an intake end and an outtake end;

a t-joint having an intake port, a handle port, and a separator hose port, the outtake end of the intake hose fluidly connected to the intake port of the t-joint;

a first check valve positioned between the separator hose port and the intake end of the intake hose;

a bellowed pump handle fluidly connected to the handle port of the t-joint, the bellowed pump handle having a plurality of crests and a plurality of valleys;

a plurality of tubular supports, a single tubular support positioned in each crest inside of the bellowed pump handle;

a plurality of bands, a single band positioned within each valley on an outer surface of the bellowed pump handle;

a separator hose having a first end and a second end, the first end of the separator hose fluidly connected to the separator hose port of the t-joint;

a second check valve positioned between the second end of the separator hose and the t-joint; and a terminal catchment vessel fluidly connected to the second end of the separator hose;

wherein upon pulling of the pump handle in a generally upward direction, intake pumping action is initiated drawing water and solid materials into the intake hose, opening the first check valve and closing the second check valve; and wherein upon pushing of the pump handle in a generally downward direction, discharge pumping action is initiated, closing the first check valve and opening the second check valve transferring any water and chambered solids into the catchment vessel further comprising:

a first groove hinge formed in the first check valve defining a first stationary portion and a first movable portion, the first movable portion movable relative to the first stationary portion along the first groove hinge; and a second groove hinge formed in the second check valve defining a second stationary portion and a second movable portion, the second movable portion movable relative to the second stationary portion along the second groove hinge.

* * * * *